US007044072B2

(12) United States Patent
Converse et al.

(10) Patent No.: US 7,044,072 B2
(45) Date of Patent: May 16, 2006

(54) CYLINDRICAL HULL STRUCTURE

(75) Inventors: Robin M. Converse, Houston, TX (US); Young Chan Park, Houston, TX (US)

(73) Assignee: SparTEC, Inc., Houston, TX (US)

( * ) Notice: Subject to any disclaimer, the term of this patent is extended or adjusted under 35 U.S.C. 154(b) by 94 days.

(21) Appl. No.: 10/953,992

(22) Filed: Sep. 29, 2004

(65) Prior Publication Data

US 2006/0070568 A1 Apr. 6, 2006

(51) Int. Cl.
*B63B 1/00* (2006.01)

(52) U.S. Cl. ..... 114/59; 405/195.1

(58) Field of Classification Search ..... 114/59; 405/195.1

See application file for complete search history.

(56) References Cited

U.S. PATENT DOCUMENTS 1,303,689 A * 5/1919 Leparmentier ..... 114/61.3
4,656,959 A * 4/1987 Moisdon ..... 114/56.1
4,702,321 A * 10/1987 Horton ..... 166/350
5,558,467 A * 9/1996 Horton ..... 405/195.1
6,161,620 A * 12/2000 Cox et al. ..... 166/367
6,244,785 B1 * 6/2001 Richter et al. ..... 405/195.1
2003/0165361 A1 * 9/2003 Richter et al. ..... 405/195.1

* cited by examiner

*Primary Examiner*—Jesus D. Sotelo
(74) *Attorney, Agent, or Firm*—D. Neil LaHaye; Eric Marich

(57) ABSTRACT

An improved floating circular hull construction arrangement. The hull is divided into sections by watertight flats. In each section, longitudinal stiffeners spaced around the inside of the outer shell terminate adjacent the flats and do not penetrate the flats. The longitudinal stiffeners are supported by full rings that are concentric with the center of the hull. The rings are received over the longitudinal stiffeners, extend radially inward and are laterally supported with members configured to act in tension in either axial direction and which are parallel to the longitudinal axis of the hull. Rings on the inner shell extend radially outward toward the outer shell and may be laterally supported similarly to the lateral supports of the outer shell. The flats are stiffened with angles or bulb tees curved to form concentric circles that are in turn supported with radial girders spaced around the flats and spanning between the inner and outer shells. The compartments are assembled with the circular sections in a vertical orientation to minimize self-weight distortion during erection. The completed circular sections are rotated to the horizontal to be joined to the other sections to form a complete cylinder.

11 Claims, 17 Drawing Sheets

CYLINDRICAL HULL STRUCTURE

FIELD AND BACKGROUND OF INVENTION

The invention is generally related to floating offshore structures and more particularly to cylindrical hulls.

The offshore oil and gas industry utilizes various forms of floating systems to provide "platforms" from which to drill for and produce hydrocarbons in water depths for which fixed platforms, jack-up rigs, and other bottom-founded systems are comparatively less economical or not technically feasible. The most common floating systems used for these purposes are Spar Platforms (Spars), Tension Leg Platforms (TLPs), Semi-Submersible Platforms (Semis), and traditional ship forms (Ships). All of these systems use some form of stiffened plate construction to create their hulls. The present invention generally applies to those systems, or portions of those systems, in which the stiffened plate section is cylindrical, in the broad sense of the term. Additional aspects of the invention apply particularly to cylindrical hulls that are circular in cross section. Circular cylindrical hulls are most commonly characteristic of Spars, Mono-column TLPs, and legs (columns) of Semis.

In the prior art, the structural arrangements and methods of assembly are based on ship design practices developed over many years. In these systems, the shell plate or structural skin is first stiffened in the longitudinal direction of the cylinder, usually with structural angles or bulb tees. This plate, stiffened in one direction, is then formed into a full cylinder or a section of a cylinder with these stiffeners parallel to the centerline of the cylinder. Whether the form is curved or flat-sided, the shape of the cylinder is locked in place using girders or frames oriented transversely to these longitudinal stiffeners. These frames are located at relatively uniform intervals in order to limit the spans of the stiffeners to acceptable distances. The spans of these girders and frames themselves may be shortened using intermediate supports, as determined by the designer, in order to optimize the design by choosing to fabricate the extra supports instead of fabricating larger girders for longer spans.

The spacing of the longitudinal stiffeners is based on 1) a minimum distance required for access between the stiffeners for welding to the shell plate (approximately 22 to 26 inches) and 2) a balance between shell plate thickness and stiffener spacing for the plate-buckling checks. The frames or girders transverse to the stiffeners are spaced at least four feet apart for in-service inspection access and up to eight feet depending upon how the design engineer elects to balance the stiffener sizing with the girder spacing.

Like all floating systems, cylindrical hulls are divided into watertight compartments in order to accommodate specified amounts of damage (flooding) without sinking or capsizing. With the exception of a specialized version of the Spar concept that uses a grouping of smaller diameter, circular cylinders to create much of its compartmentation, the sections of the cylindrical hulls are divided into compartments by watertight flats and bulkheads. These terms may have somewhat different meanings in Spar hulls since these hulls have cylinders that float vertically in service compared to ship hulls that float horizontally. In Spars, TLPs, and other deep-draft columned hulls, the flats are perpendicular to the longitudinal stiffeners and the bulkheads are parallel to these stiffeners, while in ships they are the opposite. The descriptions herein will use the terms as applied to Spars and other vessels with vertically oriented cylindrical sections.

Carried over from ship design practices of the prior art, the longitudinal stiffeners are made structurally continuous through, or across, the flats so the stiffeners can be considered to act together structurally with the shell plate when computing the total bending capacity for the cylinder. This is accomplished either by making the stiffeners pass continuously through the flats or by stopping the stiffeners short of the flats and adding brackets on either side that replace the structural continuity that was lost in stopping the stiffeners. When the stiffeners pass through a flat, the holes in the flat have to be closed up to maintain the flat's watertight integrity. When the stiffeners do not pass through the flat, a great number of relatively large brackets must be added and these brackets must align axially across the flat. Both approaches are very labor intensive and thus very costly.

In ships, where the design is largely controlled by loadings from longitudinal bending rather than from hydrostatics, this continuity of the stiffeners over the length of the shell plate is structurally warranted. In 1) vertically oriented, single cylinder hulls, 2) in multi-leg TLPs and 3) Semis with horizontal pontoons submerged quite deep compared to ship drafts, loadings from hydrostatics, instead of loading from longitudinal bending, control much of the sizing of the hull structure. For these floating systems, the structural continuity of the stiffeners, which is so valuable in ship design, is not particularly valuable in non-ship-type hulls. However, in the prior art, this fundamental difference in loadings has not been reflected in the design of the Spar and similar cylindrical hulls.

FIGS. 1 and 2 illustrate cross sections of a prior art, cylindrical, Spar hull construction arrangement. A flat-sided, flooded centerwell 100 that is square or rectangular in shape is provided to accommodate a regular array of risers. Radial bulkheads 180 connect the corners of the centerwell 100 to the outer cylindrical shell and extend the full height of the cylinder. The longitudinal stiffeners 120 of the outer shell, centerwell shell, and radial bulkhead shells are continuous and pass through the girders 140, and also the flats 160 that separate the cylinder into water tight compartments. Because the compartments must be water tight, any passages provided in the plates 160 to allow continuity of the longitudinal stiffeners 120 must be sealed after assembly. This requires a large amount of labor and also increases the risk of a leak due to the large number of areas that must be sealed by welding.

The radial bulkheads 180 create very stiff points of support for the girders 140 on the outer shell. Under the dominant loading, which is hydrostatic, these supports inadvertently cause these girders to act as bending elements spanning between these supports and, in the case of circular cylinders, prevent them from acting far more efficiently as rings in compression. Since the girders 140 are acting in "beam action" instead of acting as compression rings, the capacity of the shell plate in circular cylinders to carry hydrostatic loadings is also greatly under utilized since only part of the plate is effective as the compression flange of the girders ("effective width").

The straight sides 200 of the centerwell 100 necessarily cause the girders 140 of the centerwell 100 to act as bending elements under the dominant hydrostatic loadings. The radial bulkheads 180 themselves only see hydrostatic loading in the circumstances where an adjacent compartment floods but, in such circumstances, the girders also act as bending elements spanning between the centerwell shell and outer shell. All the girders for these shells and bulkheads must be located in the same horizontal plane so their end terminations can be tied together to provide structural continuity. Consequently, these end terminations have complex curved transitions where they join each other. These very labor-intensive transitions are required to mitigate "hot spot" stresses at these highly loaded locations but, they only reduce, not eliminate, the extent of these stresses. As a result, additional labor-intensive insert plates are normally included in the girder webs to reduce the remaining hot-spot stresses to values below stress allowables. "Tripping brackets" 220 (out-of-plane gusset-type lateral bracing for the girders) are added to brace the girders against torsional buckling.

The arrangement of the structural framing for cylindrical hulls in the prior art directly impacts the plan for the fabrication of sub assemblies and the erection of the full hull. In the prior art of Spar hulls, the cylindrical tanks are divided into sections (sub-assemblies), both in plan (with radial bulkheads) and longitudinally (with flats). These portions of the cylinder were pre-fabricated in jigs and then moved to the final assembly site where they were joined to make full circular sections. These sub-assemblies are normally constructed on their side primarily to use the weight of the section to conform the outer shell to the curvature of the jig or form. These sub-assemblies are removed from the jigs in an advanced state of structural completion and rotated one hundred eighty degrees to complete the pre-outfitting on the outer shell and then rotated again to be joined into the hull cylinder, which is assembled on its side. The cylindrical columns for Semis and TLPs are normally assembled vertically while the pontoon cylinders for Semi's and cylinders for Spars are normally assembled horizontally. Assembling cylinders when they are supported on one side by the fabrication supports requires the sub-assemblies to be very stiff to avoid unacceptable distortion of the lower section as the other sections above the lower section are added. While these sections are naturally very stiff when made as quadrants in the jigs and thus amenable to the loadings from horizontal assembly, this stiffness works against the need for flexibility to fit the sections together. The result is a contradiction in the stiffness requirements of erection handling versus fit-up that complicates the assembly process.

SUMMARY OF INVENTION

The present invention addresses the shortcomings in the known art by providing a more simplified structure. Radial bulkheads are eliminated by having the hard tank compartmented only with flats. Without radial bulkheads, the curved rings on the outer shell are configured in full circles and, in combination with the outer shell plate, are freed to act as compression rings that 1) exhibit a high degree of structural utilization and 2) virtually eliminate local "hot spot stresses" in the outer shell structural system, thus eliminating "insert plates" in the shell stiffening rings. These rings are laterally braced against torsional buckling using tension-type members in lieu of the "tripping brackets" common in the prior art. The tension-type bracing requires only a small fraction of the weight and fabrication labor of the tripping brackets.

Longitudinal stiffeners along the length of the outer shell terminate immediately before the location of a flat so the flats are neither penetrated by these stiffeners nor are the stiffeners made structurally continuous across the flats using pairs of brackets. As a result, the framing is simplified while Terminating the longitudinal stiffeners short of the flats requires that the ends be sniped (cut back) at 45 degree (American Bureau of Shipping requirement). These sniped ends may need to be reinforced to carry the local loads in the stiffener web in the area where the stiffener flange has been removed. This reinforcing can be accomplished in several ways but the preferred way is to square cut the end of the stiffener short of the flat approximately the depth of the stiffener and add a thicker piece of snipe-shaped plate to the flat side of the stiffener. Except at the locations of the circumferential splices of the outer shell plate, these reinforcing plates can be attached to the ends of the stiffeners in the shop where the welding positions and access are optimum.

The flooded centerwell is circular instead of rectangular and, without the radial bulkheads, its shell plate is freed to always act in tension from the hydrostatic loadings of the water contained inside. With the centerwell shell plate always in uniform hoop tension, longitudinal stiffeners are not required on this shell and the circular stiffening can be relatively small. The smooth circular shape of the shell and stiffening eliminates the hot spot stresses in these ring stiffeners so prevalent in the prior art. The circular centerwell also creates a constant distance between the inner and outer shells which allows a uniform pattern of stiffening for the flats compared to the prior art which had straight sides on the centerwell and a curved outer shell resulting in varying spans and irregular stiffening patterns between the shells.

For each flat, the stiffeners are curved into concentric circles that are supported by girders located on radial lines and spanning between the inner and outer shells. The circular pattern of the stiffeners insures the plate spans the same distance between stiffeners and between the edge stiffeners and the shell plates. The stiffener size increases with increases in radius to accommodate the increasing stiffener spans between radial girders towards the outer shell plate. The girders themselves are all identical but are varied in depth along their length, becoming deepest near the outer shell where the spans and thus the loads from the stiffeners are the largest.

With the cylinder compartmented only with flats, only one shaft for personnel access is required.

The closer spacing of the flats allows the compartments to be erected vertically with the flats themselves located near the ground. This permits full cylinders to be erected without deleterious effects from gravity, locates a larger percentage of the welding near the ground and provides full crane access throughout sub-assembly.

With full or partial compartments fabricated vertically then rotated 90 degrees to be joined to another section during final assembly, the flexibility of the end opposite the flat is valuable when joining it to the end of the adjacent section containing the flat since the end with the flat is very stiff. Since the longitudinal stiffeners do not penetrate the flats, only the outer and inner shell plates and the access shaft shell plate are circumferentially spliced together simplifying the connection work to be done in the erection phase.

The various features of novelty which characterize the invention are pointed out with particularity in the claims annexed to and forming part of this disclosure. For a better understanding of the present invention, and the cost efficiencies attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings forming a part of this specification and in which reference numerals shown in the drawings designate like or corresponding parts throughout the same.

DETAILED DESCRIPTION OF THE PREFERRED EMBODIMENTS

Figure 1:
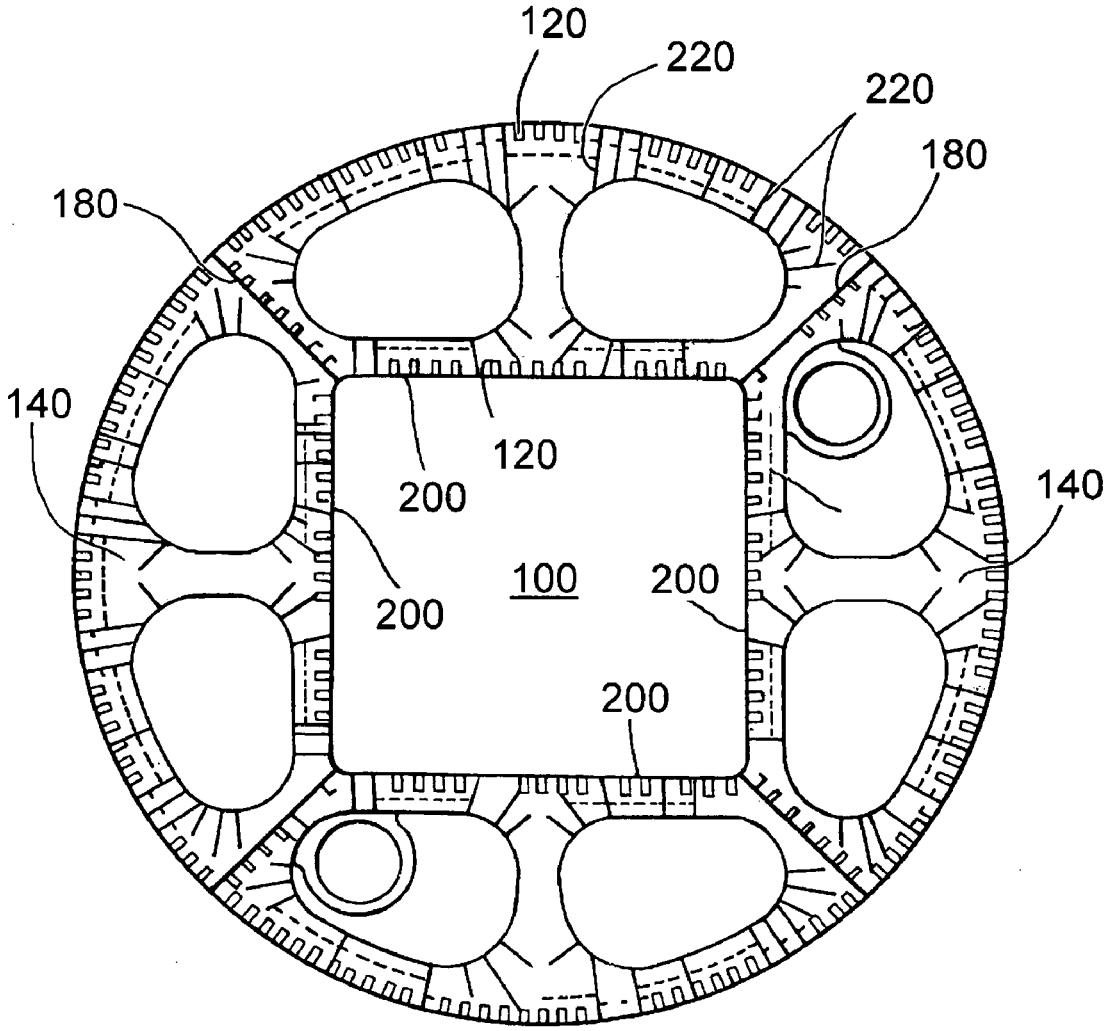
FIG. 1 PRIOR ART
FIGS. 1 and 2 illustrate cross section views of the prior art hull arrangement at different levels.
Figure 2:
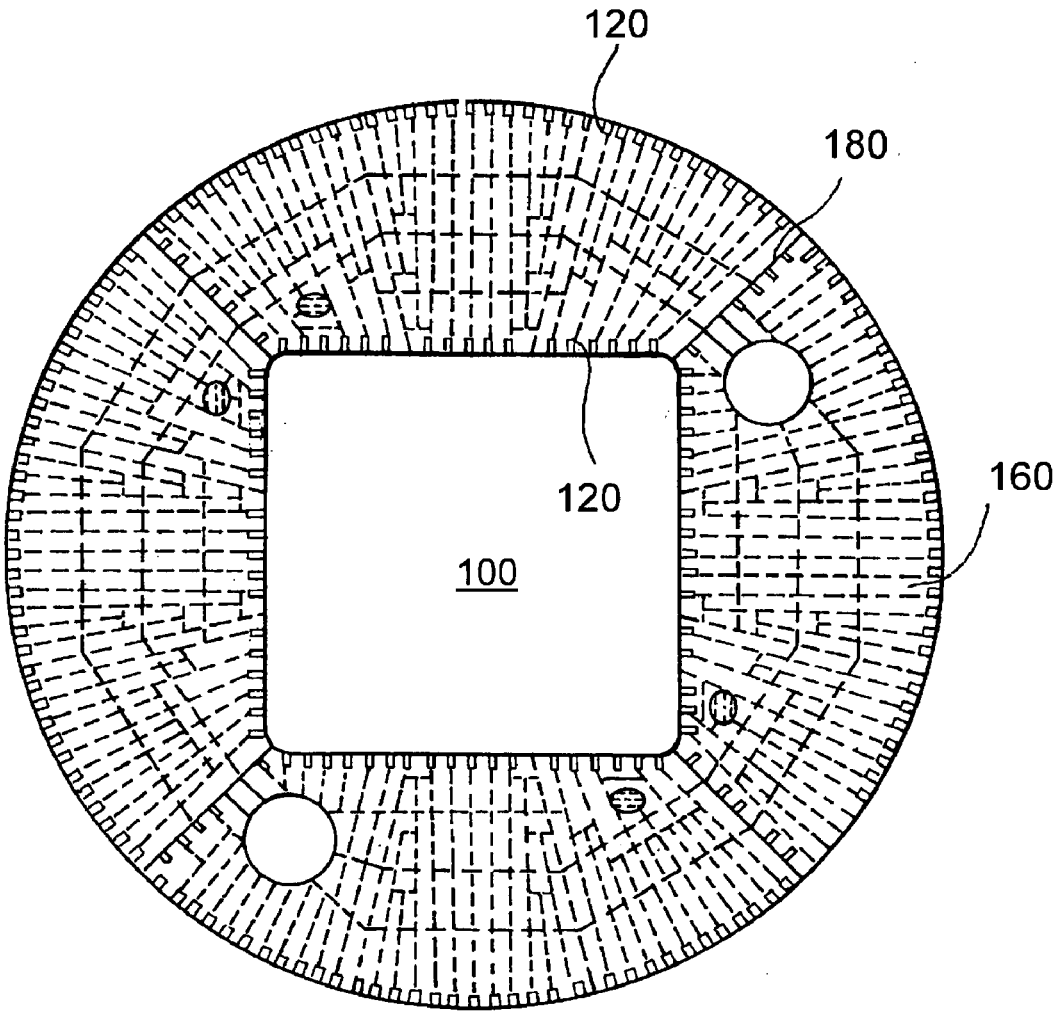
FIG. 2 PRIOR ART
Figure 3:
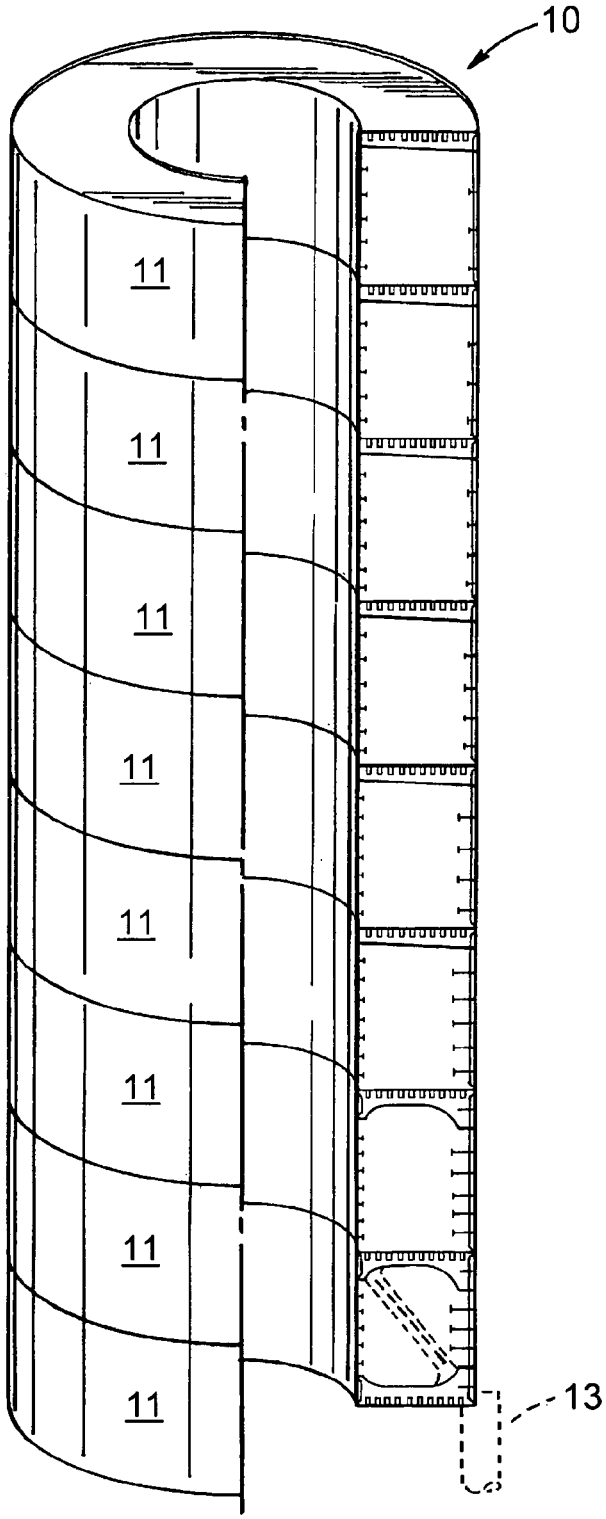
FIG. 3 is a partial cutaway view that, illustrates a cylindrical hull according to the invention.

FIG. 3 generally illustrates a cylindrical hull 10 constructed according to the invention. The hull 10 is formed from a plurality of separate hull sections 11 that will be more fully described below. One receiver 13 is illustrated for a configuration where the hull 10 may be used to receive the upper leg of a space frame or topside as disclosed in U.S. Pat. No. 5,558,467. Although only one receiver is shown, a suitable number of receivers 13 would be provided. Also, it is important to note that the hull construction of the invention is suitable for a variety of structures and not only the type of structure disclosed in the above-referenced patent.

Figure 4:
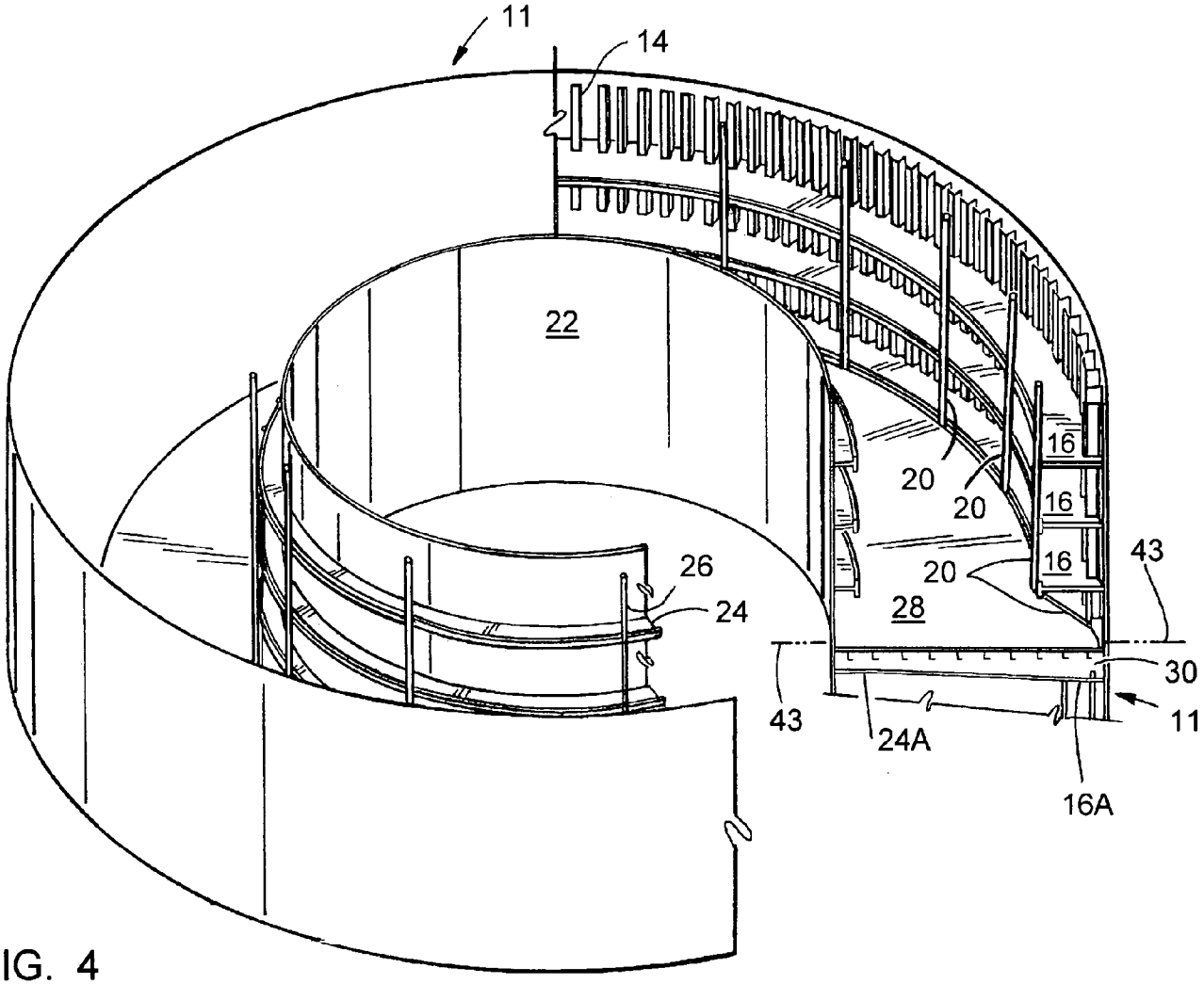
FIGS. 4 and 5 are perspective, partial cutaway views that illustrate the invention.

FIG. 4 illustrates the structural arrangement of a portion of one section 11 of the cylindrical hull 10 according to the invention and a smaller portion of a second section 11. The outer shell 12 of the hull 10 is provided with a plurality of longitudinal stiffeners 14, rings 16 and tension-type lateral supports 20 for the rings 16. The lateral supports 20 are provided only: at the same locations as selected radial girders 30 and are anchored at each end of a hull section (compartment) in order to act in tension under all loading conditions. The inner shell 22 of the hull 10 is provided with circular ring stiffeners 24 and optional tension-type lateral supports 26 for rings 24. These structures are discussed in further detail below.

Figure 5:
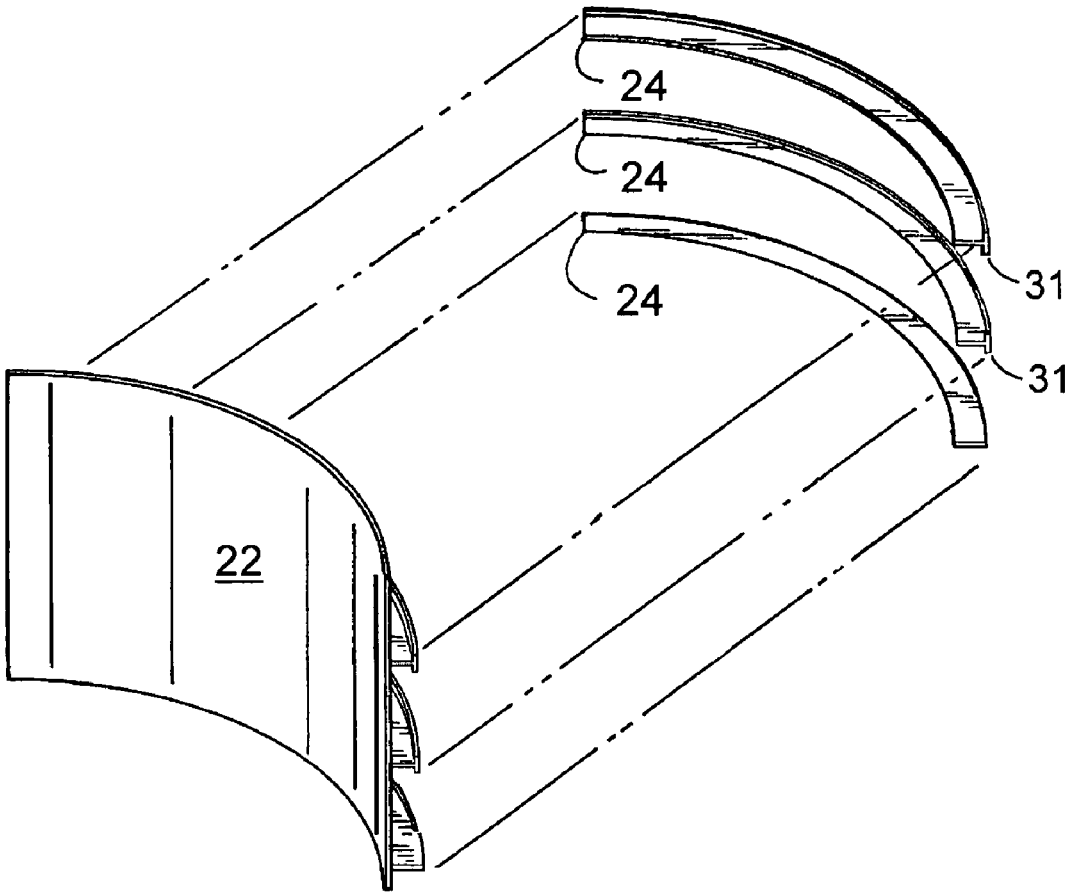

As seen in FIG. 5, each ring 24 on the inner shell 22 may also be provided with a flange 31, although those rings on the inner shell that weld to the radial girders will not normally need flanges since their spans are relatively short. FIG. 5 illustrates the rings 24 both on and off of the inner shell 22 to provide a clear understanding of the construction. The flanged rings 24 are preferably rolled T's, to provide ease of construction, but may also be formed by any other suitable means such as cut flat plate for the webs with a rolled flange welded thereon.

Figure 6:
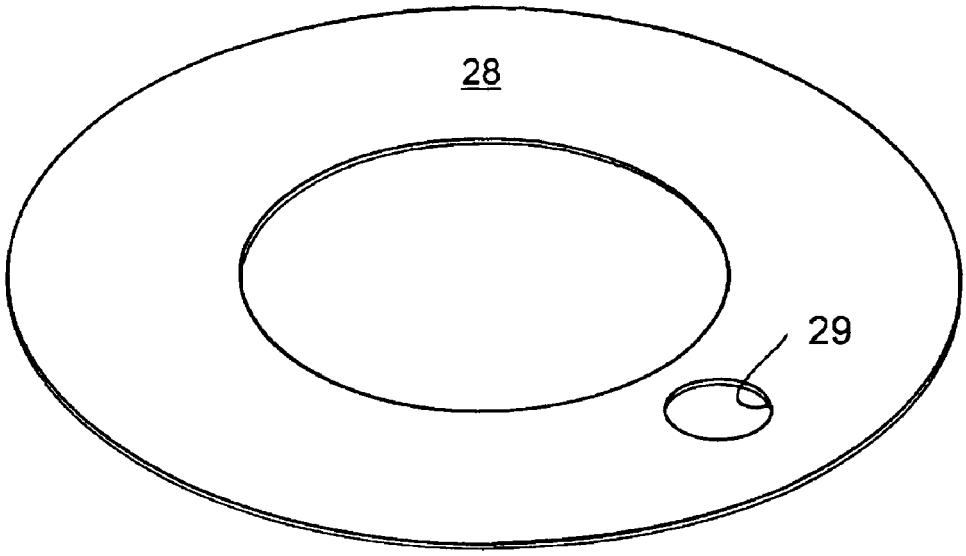
FIGS. 6, 7, and 8 illustrate the construction of the flat plate with the radial girders and girder stiffeners.

As seen in FIG. 6, a flat circular plate 28, which will form a watertight compartment division also referred to as a "flat", has a central opening approximately equal to the outer diameter of the inner shell 22 and an outer diameter approximately equal to the inner diameter of the outer shell 12.

Figure 7:
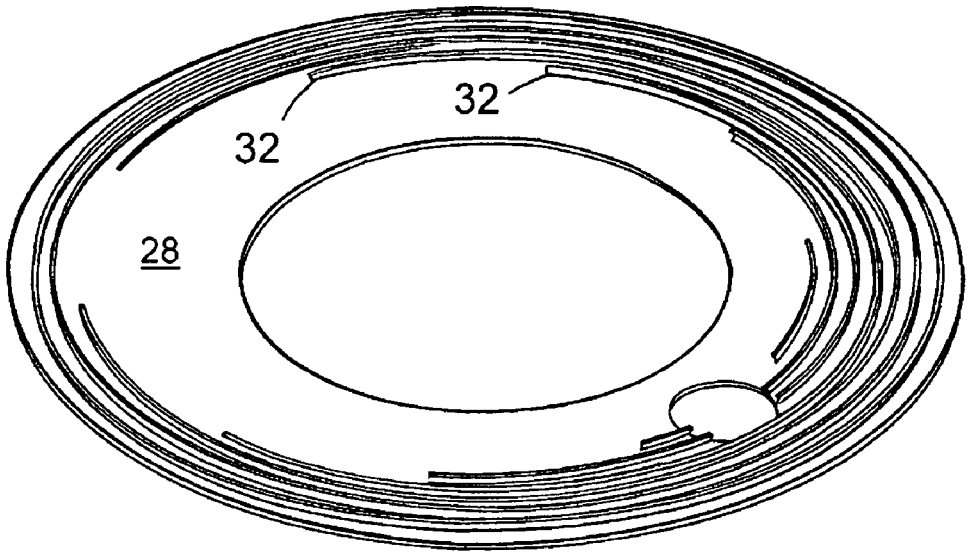

As seen in FIG. 7, a plurality of circular stiffeners arranged concentrically are added to the plate of the flat for stiffening. The curved stiffeners 32 are formed from angle iron or bulb tees and are placed on edge on the circular flat plate 28 with the flanges toward the outer shell plate to facilitate the cold bending operations of the stiffeners themselves.

Figure 8:
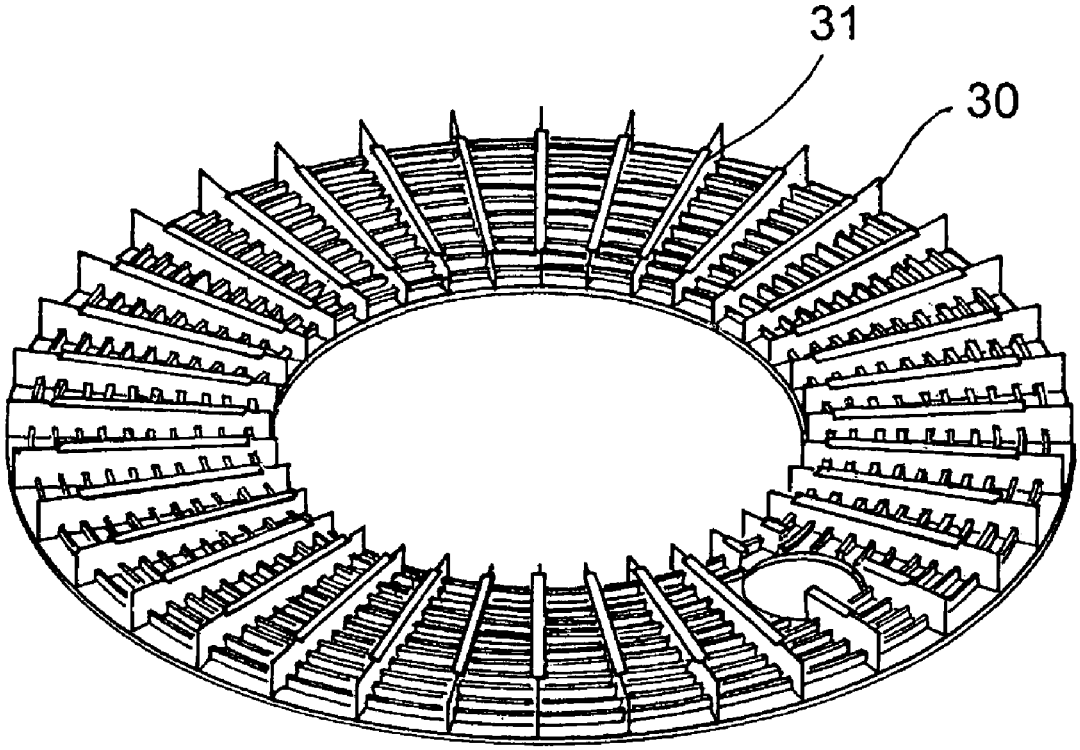
Figure 9A:
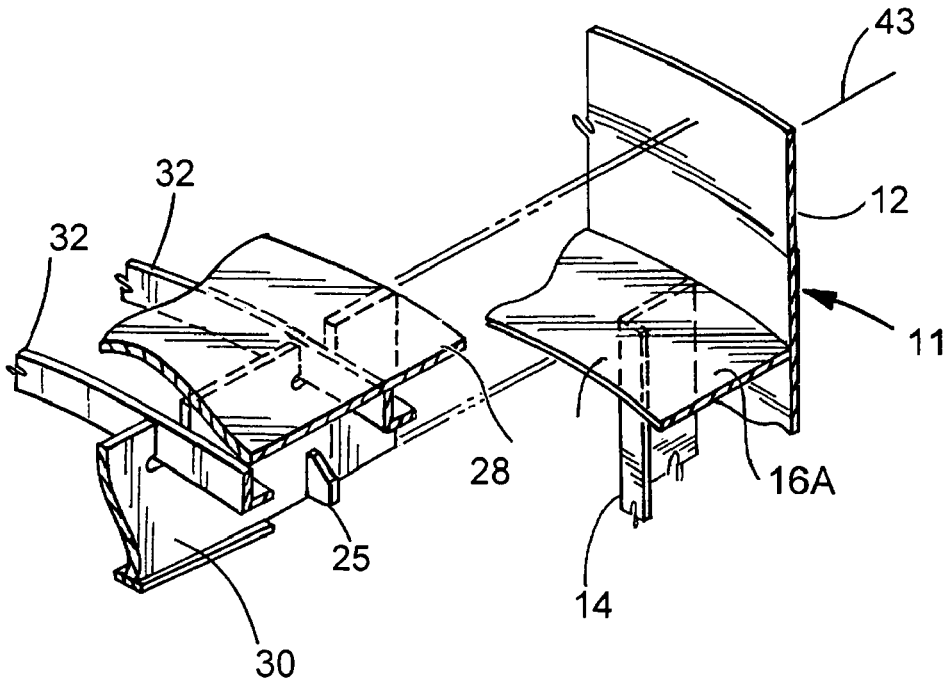
FIGS. 9 and 10 illustrate the invention in relation to the outer shell of the hull and its relationship to the flats.
Figure 9C:
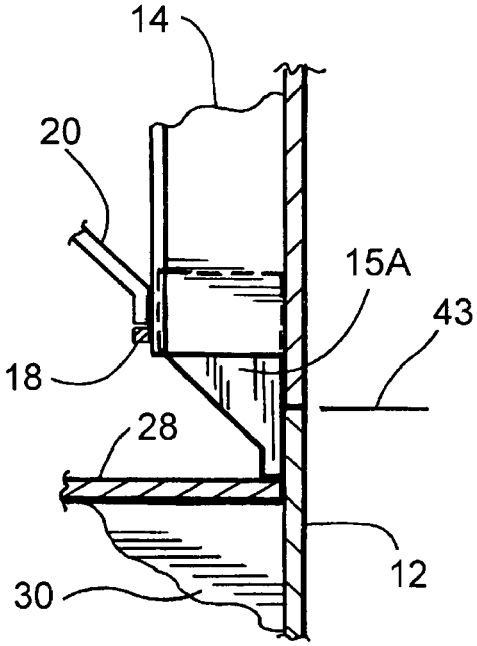
Figure 9D:
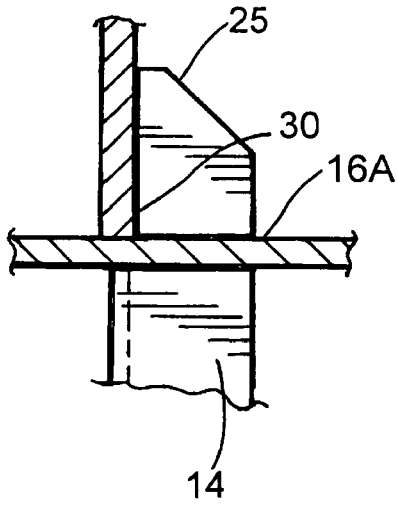
Figure 9B:
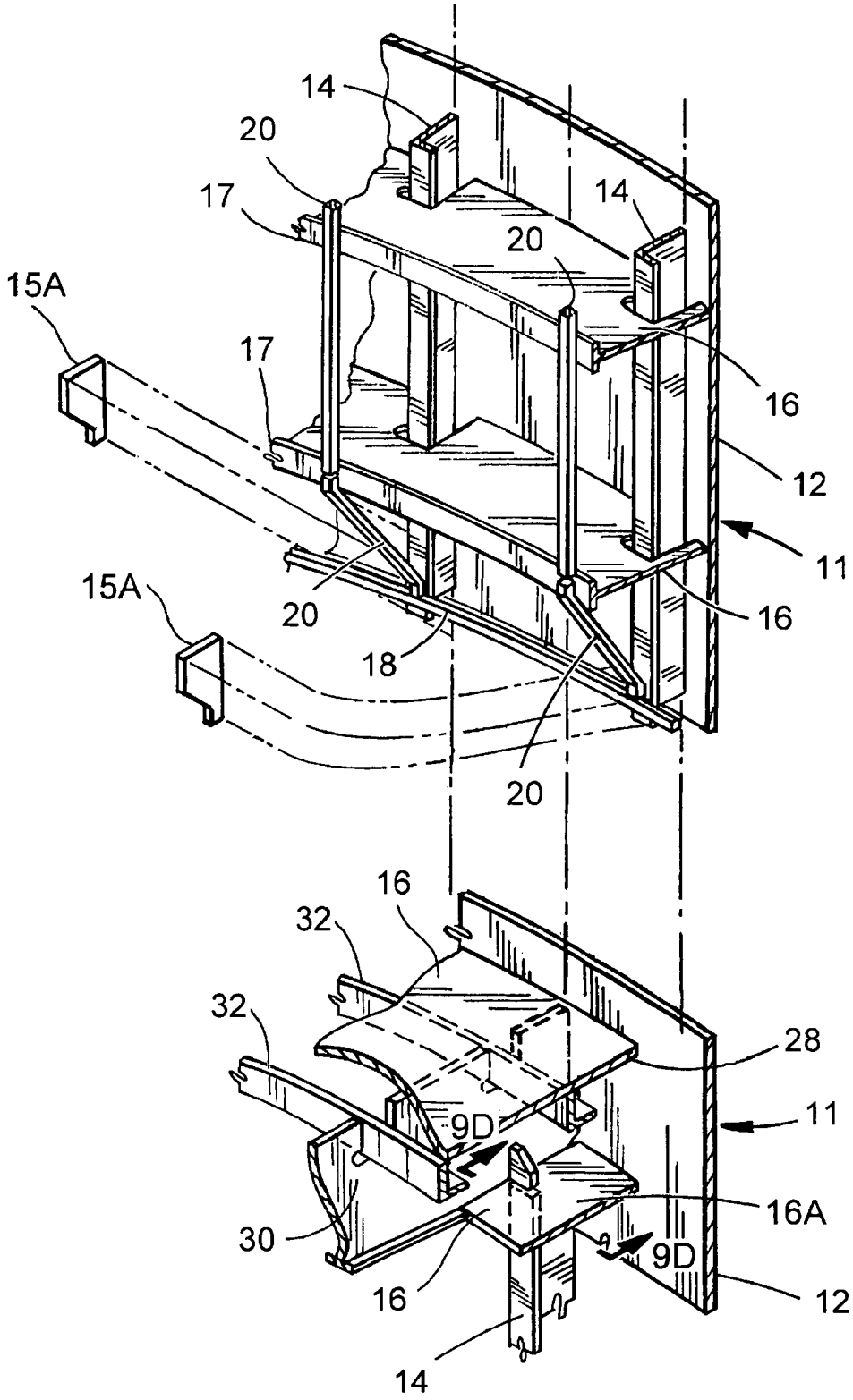

As seen in FIG. 8, a plurality of radial girders 30 are welded to the flat and to the circular stiffeners to support the stiffeners and further stiffen the flat. The radial-girders 30 on the flats are preferably spaced apart in line with every third or fourth longitudinal stiffener 14 on the outer shell following a radial line toward the center of the cylinder. The radial girders 30 are essentially fabricated tees that may be tapered in depth and that are welded to the outer and inner shells 12 and 22 when the shells are erected onto the flats. The drawings and description illustrate the form of the radial girders that are suitable for the major portion of the length of the hull. Due to increased hydrostatic pressures at the lower end of a deep draft hull, the radial girders at the lower end may need to be deeper, have haunched ends or be spaced more closely together and the opposite is the case for those girders at the upper end of the cylinder. However, the general principle illustrated in the drawings and described above is still the same. When the curved shell plate sections are set, FIG. 8, the radial girders and the plate forming the flat are then welded to the inner diameter of the outer shell 12 at one end and to the outer diameter of the inner shell 22 at the other end.

Figure 10B:
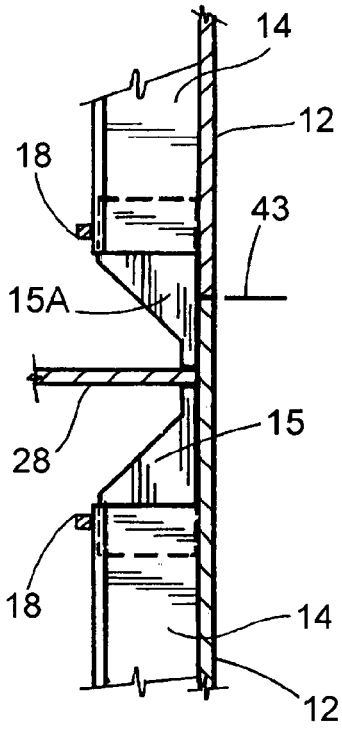
FIGS. 10A and 10B illustrate the configuration of the ends of the longitudinal stiffeners related to stopping short of the flats.
Figure 10A:
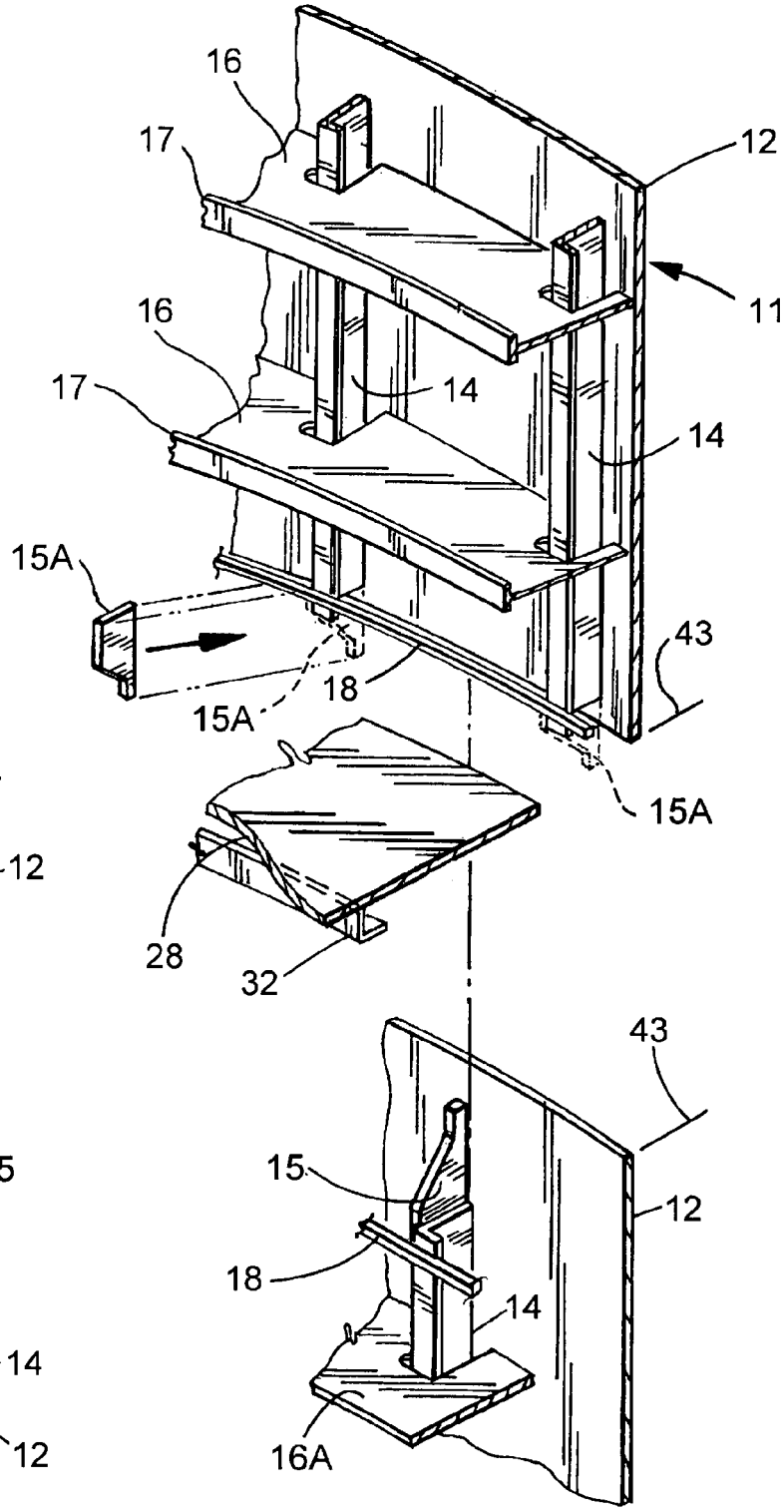
Figure 10C:
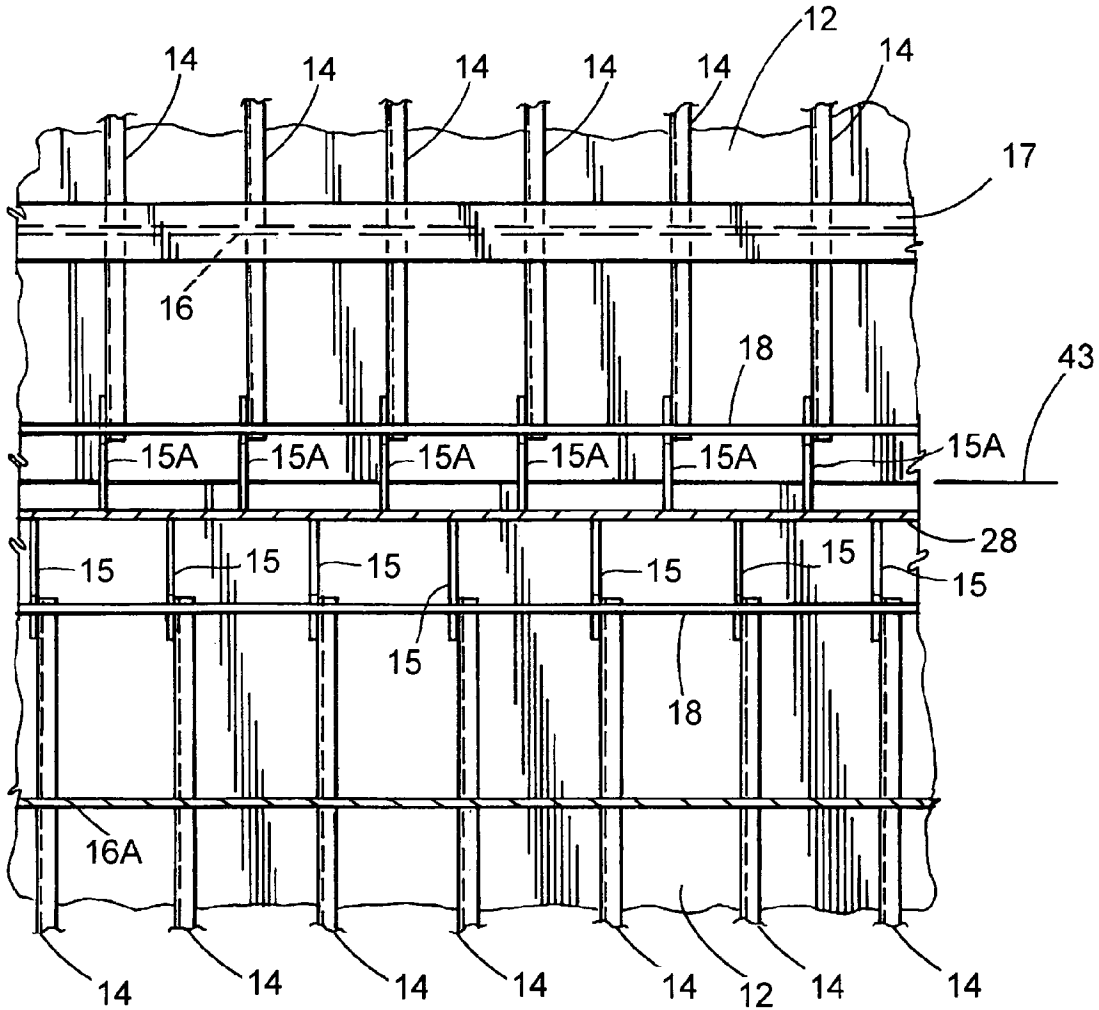
Figure 11A:
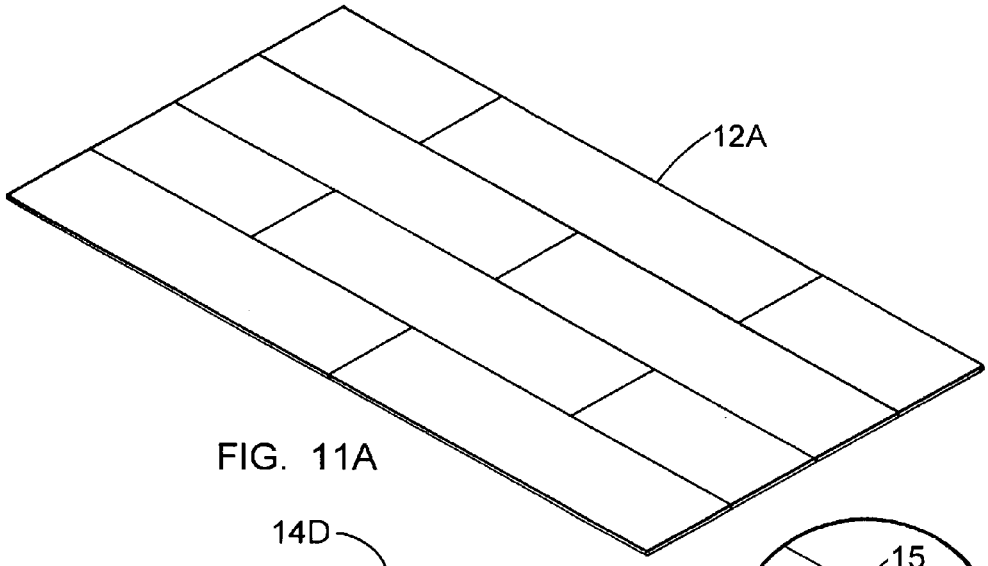
FIGS. 11A–D illustrate the construction of an outer shell section.
Figure 11B:
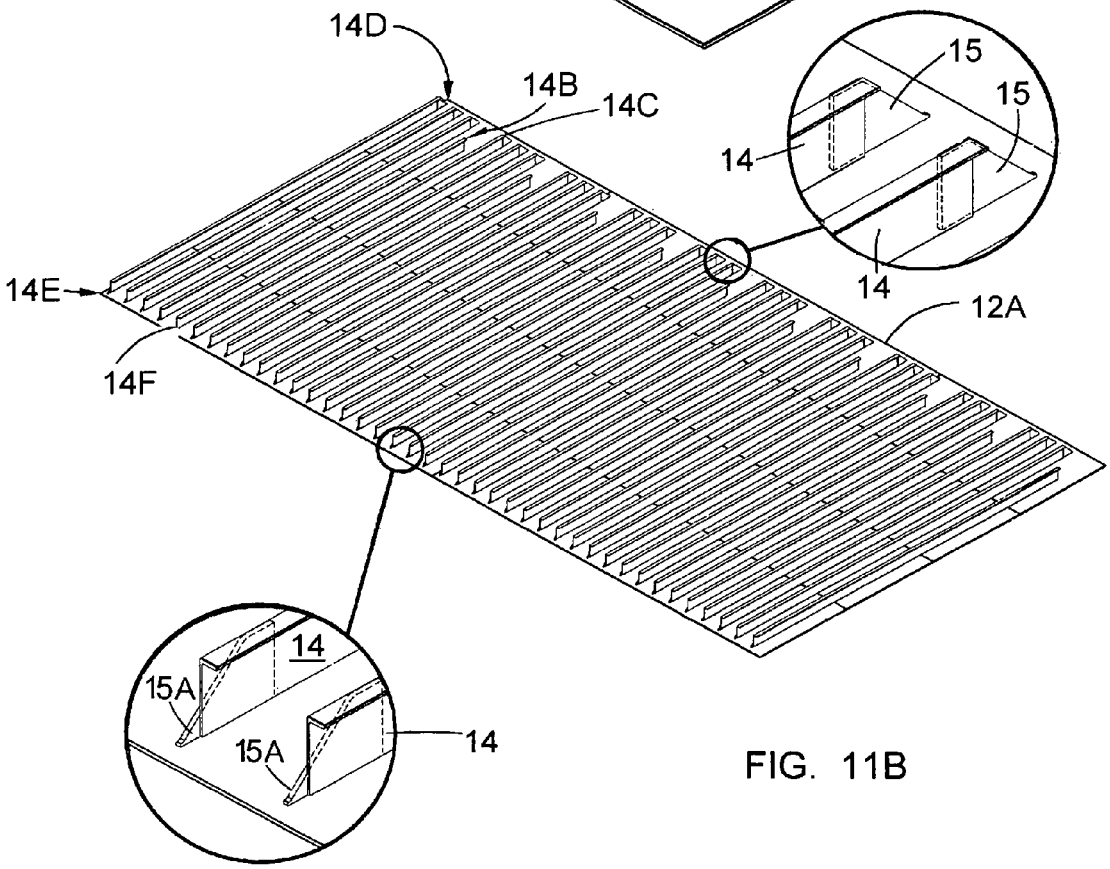
Figure 11C:
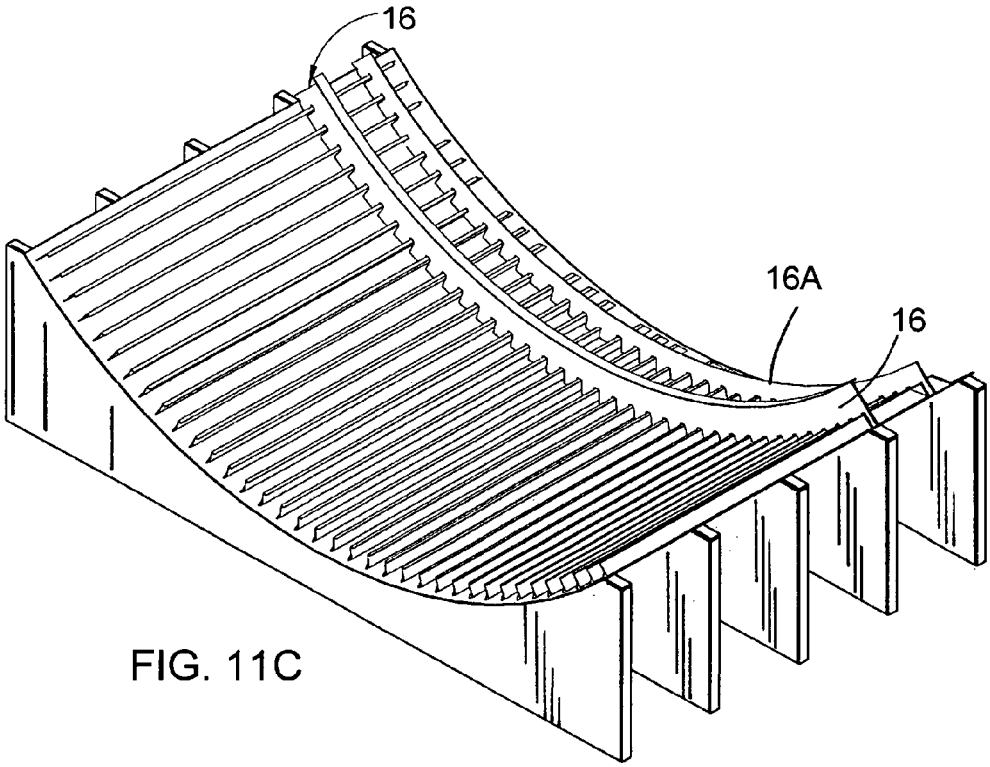
Figure 11D:
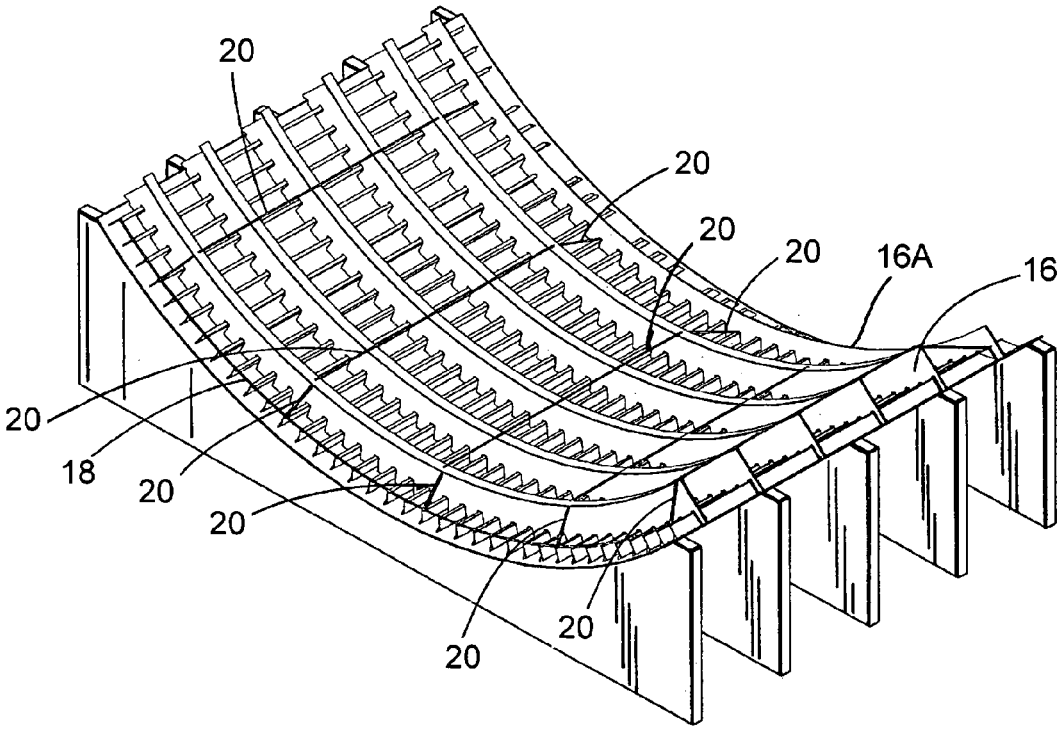

FIGS. 9 and 10 illustrate more detailed views of the arrangement of the longitudinal stiffener 14, rings 16, tension-type lateral supports 18 and 20, circular stiffeners 32 and radial girder 30 at the outershell. FIG. 9 illustrates the configuration at the locations of the radial girders on the flats while FIG. 10 illustrates the configuration at the locations between the radial girders. (It is noted that FIGS. 9 and 10 illustrate these portions of the hull structure in the normal upright and installed position. However, it will be seen from the description of the construction sequence below that each section 11 of the hull is constructed upside down compared to its orientation in the floating structure.) It can be seen that each longitudinal stiffener 14 is formed from an angle iron or bulb tee welded on one edge to the inner diameter of the outer shell 12. At the locations of both the flats and any circumferential splices of the outer shell plate, as seen in FIG. 10A, the ends of the longitudinal stiffeners 14 are preferably cut at an angle (normally 45 degrees to meet ABS requirements for terminating stiffening that is not attached to another stiffening member) instead of being square ended. At some locations in the cylinder, these sniped ends of the longitudinal stiffeners may need to be reinforced. As shown in FIG. 10B, the preferred method of reinforcement is to omit sniping the end of the stiffeners and, instead, cut the end of the stiffener square at a location approximately the stiffener depth back from the flat and add a thicker plate 15 (in the shape of a sniped end) to the flat side of the stiffener. Except at the locations of the circumferential splices of the outer shell plates, these reinforcing plates can be added to the stiffeners in the shop before the stiffeners are welded to the shell plate. At the locations of the circumferential splices of the outer shell plates, this reinforcement detail is used although the sniped plates are positioned and welded after the shell is spliced instead of welding them on in the shop in order to provide access from both sides to make the circumferential welds in the shell plate. The rings 16 are formed out of webs cut in a curved shape from flat plate and at all locations, except for those rings 16A that attach to the radial girders, the rings are flanged with flanges 17 rolled to the curvature of the inner edge of the webs and are attached to the webs. All the rings 16 and 16A are welded on edge to the inner diameter of the outer shell 12 so as to be substantially parallel to the flat circular plate 28. The rings with flanges 16 are designed to be of equal depth within any one compartment to facilitate the tension-type lateral bracing 20. The rings without flanges 16A are welded to the radial girders which provide the lateral support required since the spans of these rings between girders are relatively short.

Each hull section 11 is constructed upside down compared with its in-place orientation. The circular flat plate 28 is placed on a level work surface as seen in FIG. 6. A circular hole 29 is provided through the flat plate 28 that will serve to receive the access shaft. The curved stiffeners 32 are placed and welded in position on the flat plate 28 as seen in FIG. 7. It can bee seen that the curved stiffeners 32 are preferably rolled to match the circumference of their position on the flat plate 28 and form concentric circles. This gives the advantage of all the stiffeners 32 crossing all the radial girders 30 in a perpendicular orientation which makes for easier welding of the stiffeners 32 to the radial girders 30. A further advantage of the curved stiffeners is the equalization of the spans of the flat plate between stiffeners and between the stiffeners and the shells. The curved stiffeners 32 are welded in position on the flat plate 28 by any suitable means including manual and tracking-type semi-automatic welding units. It is preferable that the sections of curved stiffeners 32 be placed such that the joints necessary to form a continuous circular stiffener 32 do not radially overlap. The radial girders 30, which have cutouts to fit over the curved stiffeners 32, are placed over the curved stiffeners as seen in FIG. 8 and welded in place to both the curved stiffeners 32 and the flat plate 28. It can be seen that the radial girders 30 are preferably provided with a flange 31 rigidly attached to the edge of the girder for stiffening purposes. A tubular access shaft not shown is then placed in hole 29 and welded to both the flat plate and two of the radial girders to form a water tight seal between the access shaft and the flat and support the weight of the shaft in service.

The construction of the outer shell is illustrated in FIG. 11A–D. The metal 12A that will form the outer shell 12 is cut into pieces which are connected together preferentially to form a plate the height of a full or partial compartment and a portion of the circumference (normally $\frac{1}{8}^{th}$ to $\frac{1}{3}^{rd}$). The longitudinal stiffeners 14 are welded in place on this section of the outer shell while the plate is in the flat position. The stiffeners 14B and 14C are varied in length and end-prep as required to interface with the intersecting structure. At the end 14D which will be attached to the flat to form a single compartment, the stiffeners 14B are stopped short to abut the unflanged ring which is added in the jig. At the end 14E which will be attached to another section in the final assembly of the full cylinder, the stiffeners are cut short, FIG. 11C, and the reinforcing sniped-shape section 15A is pre-positioned and temporarily attached so it is readily available to be re-located and welded as soon as the circumferential splice of the outer shell plate is completed. This section of the outer shell plate 12A, with the longitudinal stiffeners 14, is laid in a jig form 34 which has the same curvature as the outer shell. The weight of the stiffened plate forms the plate to the curvature of the outer shell with little or no additional force. Rings 16, which are provided with cutouts to fit over the longitudinal stiffeners 14, are placed in position and welded to the outer shell section and to the longitudinal stiffeners. The ring 16A, without a flange 17, that will abut the radial girders 30 is also placed and welded in position. The lateral supports 20 for the rings 16 (best seen in FIGS. 9 and 11D) are placed and welded transverse to the flanges 17 and anchored at each end. These are the tension-type lateral supports noted above. By anchoring these elements at each end, the lateral supports 20 for the rings 16 act in tension in both bracing directions, resulting in a very efficient member size. The lateral supports 18 for the longitudinal stiffeners 14 are placed and welded at the ends of the longitudinal stiffeners 14 and also anchored at both ends so as to similarly act in tension at all times. The lateral supports 18 at the end away from the pre-installed flat are installed in the jig. The lateral supports 18 on the end with the pre-installed flat are added after the outer shell plate sections are erected onto the flat since these lateral supports are anchored at each end to the webs of the radial girders. Other non-structural components such as access ladders are then added. The remaining sections of the outer shell 12 are constructed in the same manner. The sections may be turned over to add exterior (convex side) appurtenances such as anodes and strakes prior to assembly of the sections to the flat or these additions may be deferred until the shell is vertically erected to the flat.

With the upper cylindrical section of the hull compartmented solely with flats, the compartment at the waterline will not normally require a second watertight outer shell section (cofferdam section) typical of the prior art. If the section of the hull that will be at the water line is required to have a cofferdam section for reasons of preference or special operational requirements, the construction of the cofferdam section and the portion of the hull inside the cofferdam section is the same as described above.

Figure 13A:
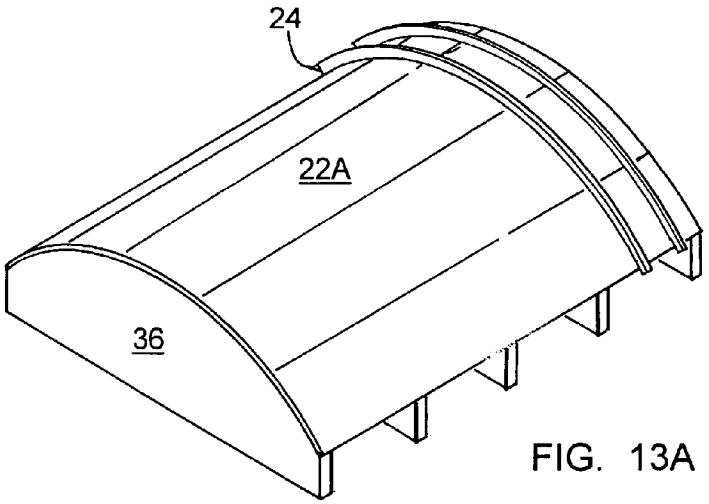
Figure 13B:
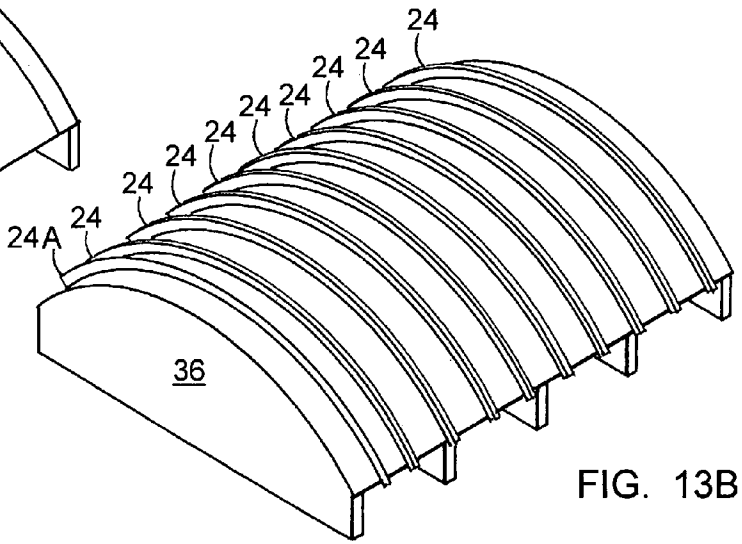
Figure 12A:
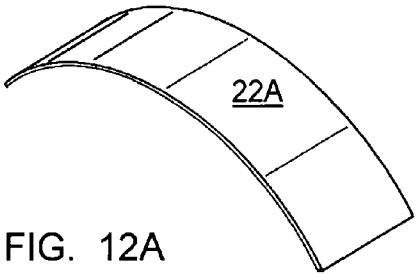
FIGS. 12A and B and 13A and B illustrate the construction of an inner shell section.
Figure 12B:
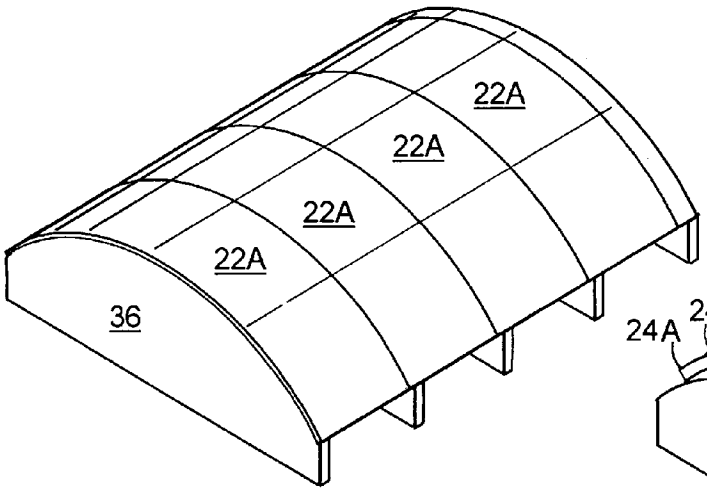

The construction of the inner shell 22 is illustrated in FIGS. 12 and 13. The metal 22A that will form the inner shell 22 is cut into sections the length of a portion of the circumference (typically $\frac{1}{8}^{th}$ to ⅓rd) and preferentially the height (width) of a mill plate. The portion of the height and circumference will depend upon the fabricator. As illustrated in FIGS. 12A and B, this section is mechanically rolled to the circumference of the inner shell and laid on a jig form 36 matching the curvature of the inner shell. Additional pieces are placed on the jig form 36 and welded together to form the height of the section. As illustrated in FIGS. 13A and B, the mechanically curved rings 24 are placed and welded in position on the section of the inner shell 22. Lateral supports for the rings 24 are generally not required but if they were, tension-type lateral supports 26 similar to those for the outer shell rings would be used. Other non-structural components such as access ladders are then added. The remaining sections of the inner shell 22 are constructed in the same manner. The sections may be turned over to add exterior (concave side) appurtenances, eg. anodes, prior to assembly to the flat.

Figure 14A:
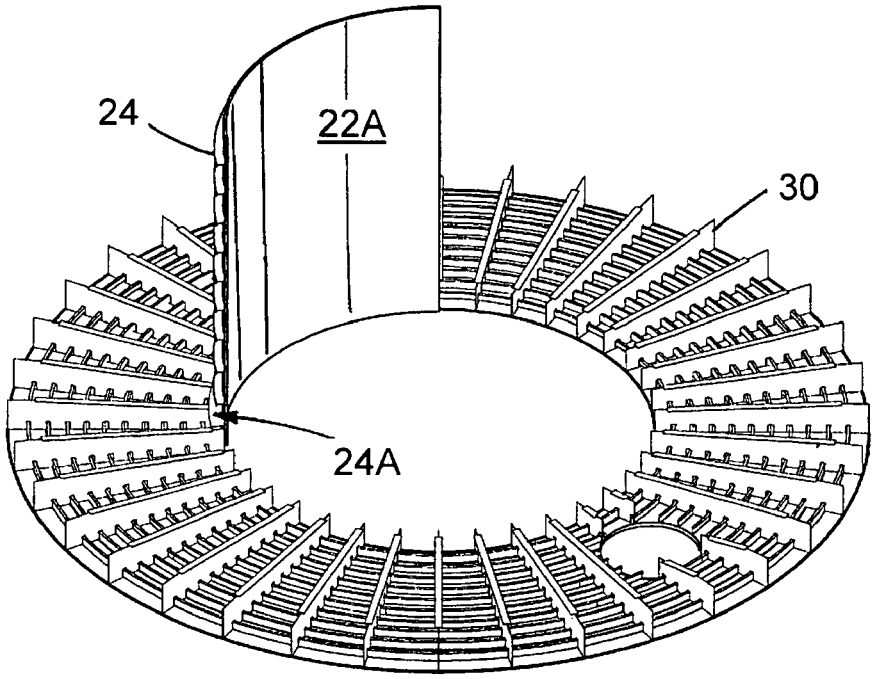
FIGS. 14A and B illustrate the connection of the inner shell to the completed flat plate.
Figure 14B:
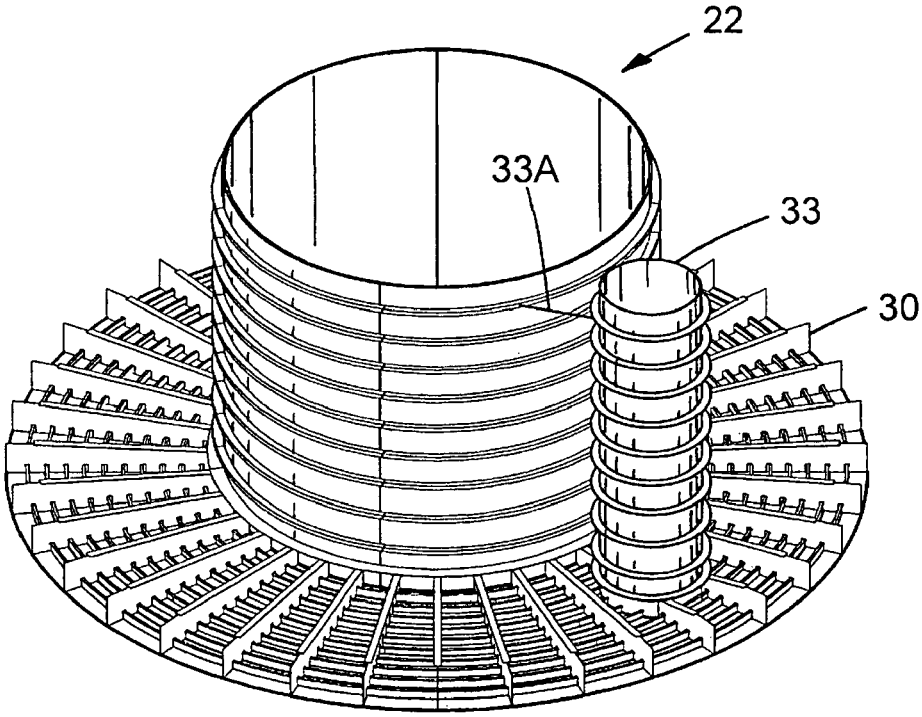
Figure 15A:
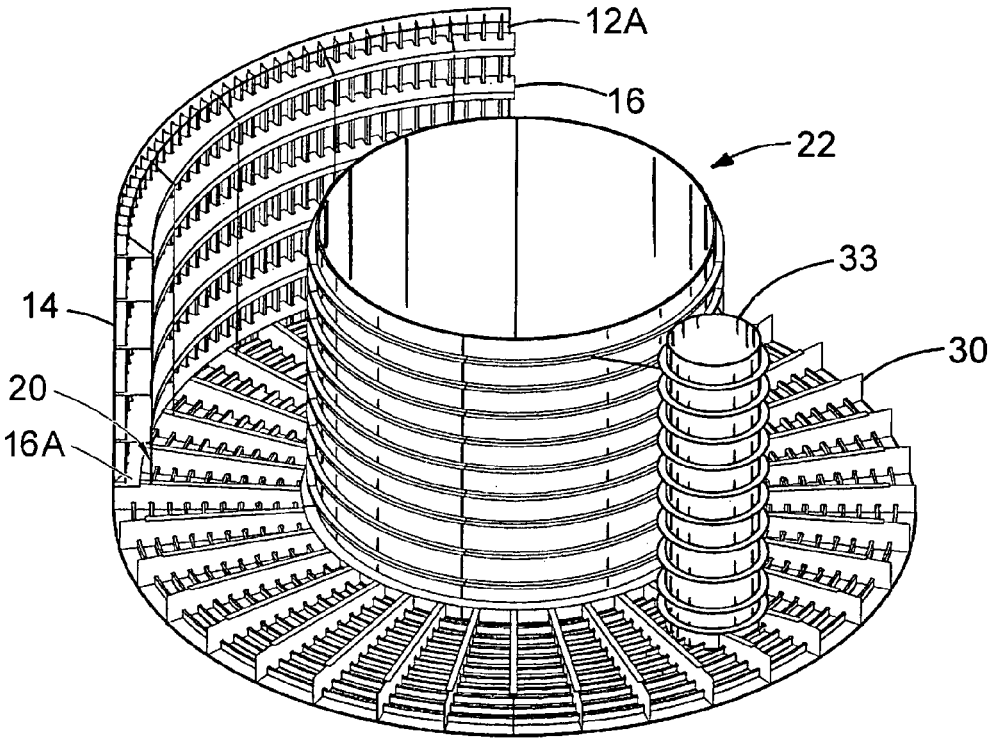
FIGS. 15A and B illustrate the connection of the outer shell to the completed flat plate.
Figure 15B:
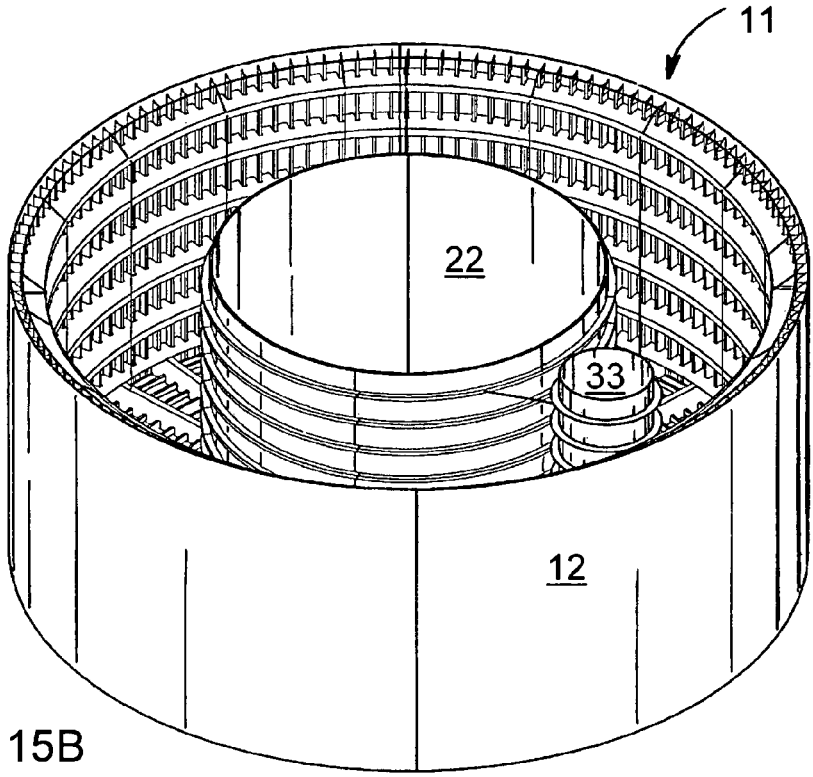

To assemble one hull compartment, or partial compartment 11, one inner shell section is stood up with one of its ends adjacent to the flat plate 28 as seen in FIG. 14A, aligned and plumbed with the flat plate 28, and welded to the flat plate 28 and the ends of the radial girders 30. The unflanged ring 24A sits on the radial girders 30 to establish the correct position and is welded to the webs and flanges of the radial girders 30. The remaining sections of the inner shell are positioned and welded in place in the same manner to form the inner shell 22 as seen in FIG. 14B. The sections that form the inner shell 22 are spliced together by welding and the rings 24 are also welded together. The outer shell is erected in the same manner. As seen in FIGS. 15A and B, each section of the outer shell is stood in position and welded to the flat plate 28 as well as to the radial girders 30. The sections of the outer shell and the rings are spliced together by welding. At the proper time in this sequence, the access shaft 33, if used, is added. Appurtenances are added at any time in the pre-fabrication and erection sequences which the fabricator considers desirable.

Figure 16:
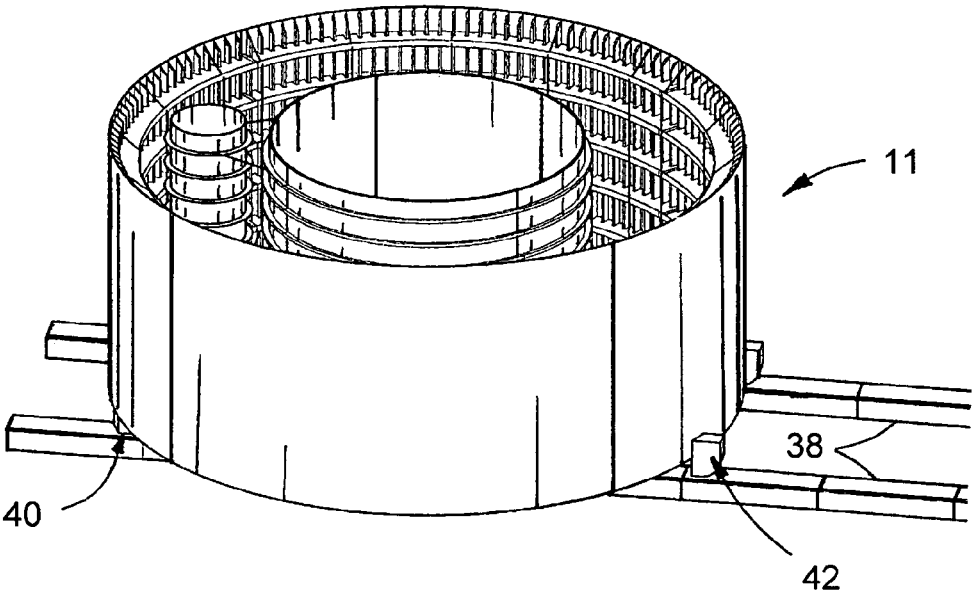
FIGS. 16 and 17 illustrate the connection of two separate hull sections.
Figure 17:
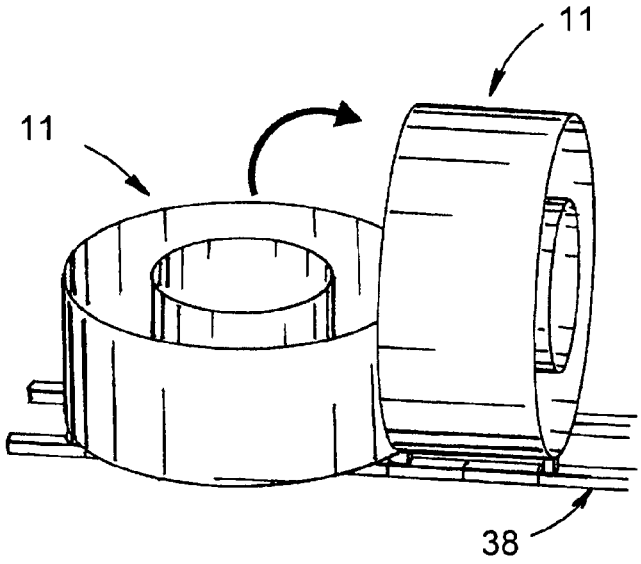

To join one section 11 of the hull 10 to the next, a temporary erection brace assembly, similar to spokes on a bicycle wheel, not shown, is placed between the inner shell 22 and the outer shell 12 at the opposite end from the flat plate 28. As seen in FIGS. 16 and 17, the constructed hull section 11 is set on skidways 38 with temporary shoes 40 and upending shoes 42. The hull section 11 is rotated either on the upending shoes or in the air so that the longitudinal axis of the hull section 11 is in a horizontal position and placed adjacent to a previously constructed hull section 11 that is also in a horizontal position. The end of the hull section 11 with the flat is placed next to the end of the adjacent hull section 11 where the temporary brace assembly is located. The two sections are moved together and then the outer shell, inner shell and access shaft shell plates are welded together. It can be seen from this explanation and FIG. 3 that the hull sections 11 are assembled upside down but connected to form a hard tank so the side of the flat plate 28 with the radial girders 30 faces the bottom of the hull when in the installed position.

The invention has several advantages over the known art.

The radial bulkheads are eliminated. This eliminates rigid supports of the inner and outer shells at four places which allows both types of shell plate and their curved stiffening to act as full rings which greatly increases their structural efficiency compared to the prior art where the shell plate and girder stiffening acted primarily in bending. The smooth lines of the full rings compared to the many intersections of girders and struts in the prior art results in the elimination of nearly all "hot spot stress" areas in the main framing which results in the elimination of insert plates and other means of remediating the stress concentrations common in the prior art. Additionally, the area of stiffened plate eliminated with the radial bulkheads is approximately 10% more than the area of stiffened plate added for additional flats to complete the compartmentation, which contributes to the lower steel weights of the invention as well as its greatly enhanced constructability, compared to the prior art for the same sized hull.

The longitudinal stiffeners on the outer shell are not made structurally continuous across the flats. This configuration eliminates the practices of either 1) penetrating the flats with the stiffeners and sealing up the resulting holes or 2) adding brackets on each side of the flat at each stiffener. On a typical Spar hull, this configuration eliminates over 800 such penetrations and their seal-plates or over 1,600 brackets. Eliminating these penetrations or brackets allows the stiffener welding to be largely completed in the shop/pre-assembly stages while, in the prior art, the penetration and bracket work must necessarily be deferred until later in the fabrication sequence when the sub-assembly sections are connected at the erection site. This configuration further simplifies the construction by eliminating the need for the longitudinal stiffeners on either side of a flat to align with each other as was the case in the prior art.

Termination of the longitudinal stiffeners on the outer shell short of the flats causes the ends to cantilever from the last ring. This ring is spaced from the flat the proper distance to balance the bending moment in the stiffener at the cantilever with the maximum moments at other spans of the stiffeners resulting in the most efficient stiffener sizing. To maximize the cantilever moment capacity of the stiffeners, the free ends are laterally braced using the tension-type members. These slender members run transverse to the ends of the stiffeners, are attached to each stiffener and are anchored at each end so they act in tension under loadings from either axial direction. This approach eliminates bracket-type lateral bracing and results in significant savings in fabrication material and labor. Terminating the stiffeners short also requires they be cut back (sniped) at 45 degrees to meet the requirements of the American Bureau of Shipping. There are several ways to reinforce the sniped ends of the stiffeners, including: lapping a thicker snipe-shaped piece onto the end of the stiffener, replacing the sloping section of stiffener web with a thicker piece in line with the web, adding a stiffener perpendicular to the web and following the incline or adding a section of flange along the incline. The advantage of this invention is that any of the methods of reinforcement can be done in the shop using automated equipment in advance of assembling the stiffeners to the shell plate. An exception to this is: at the locations of the circumferential splices where the sniped shape reinforcements are pre-made and only positioned when the stiffeners are being added then permanently put in place after the circumferential welds on the shell plate are complete.

Similar to the lateral bracing for the ends of the longitudinal stiffeners, the invention laterally braces the curved rings on the outer shell (and the inner shell rings if required) using slender members transverse to these girders and anchored to the longitudinal stiffeners at either end of a compartment so they always act in tension under loadings from either axial direction. To be most effective, this type of bracing requires the rings in any one compartment between flats be of the same depth. This is easily accomplished in the design by setting a ring depth and varying: the ring spacing, the flange widths or thicknesses of the rings to accommodate the differing hydrostatic loadings at different locations along a compartment's depth. This type of lateral bracing virtually eliminates the need for the so-called "tripping brackets" used extensively in the prior art. Since there are over 3,000 tripping brackets (often measuring several feet in each direction) in a typical Spar hull, the lateral bracing approach in the present invention greatly reduces the material and labor required to complete the hull fabrication. This same lateral bracing technique is applicable to bracing the repetitive stiffening in any other parts of the hull.

The circular centerwell is always in hoop tension which allows the shell to be stiffened with only ring stiffeners and eliminates the need for longitudinal stiffeners which greatly simplifies the stiffening of this shell plate.

The concentric circular centerwell also provides a constant distance between the two shell plates. This allows a highly repetitive and uniform stiffening pattern for the flats using radial girders. Combined with the radial girders are circular stiffeners that create perpendicular intersections of all the girders with the stiffeners, which is very desirable for welding as well as creating uniform spans of the flat plate between stiffeners themselves and between stiffeners and the shell plates, thus eliminating variations and non-uniformities which beget the special stiffening, inserts, and other remediations common in the prior art.

All of the configuration details embodied in the present invention contribute to reducing the number of pieces that need to be cut, fitted, and welded together to form the completed cylinder. Eliminating the tripping brackets and eliminating the filling of holes in the flats were mentioned above, but the configuration of the rings themselves compared to the girders in the prior art, the elimination of longitudinal stiffeners on the centerwell shell and the uniformity of the stiffening patterns of the flats all contribute to a significant reduction in the number of pieces and fewer pieces translate into lower costs.

With the flats closer together, the compartments can be economically assembled with the flats parallel to the ground and the curved shell plates erected vertically so the effects of gravity do not affect the curvature of the shell plates as would be the case if the sections of shell plate were combined into full cylinders in the horizontal position. Vertical erection of each compartment locates a higher percentage of the welding close to the ground and facilitates crane access to the interior throughout the erection of a complete compartment.

While specific embodiments and/or details of the invention have been shown and described above to illustrate the application of the principles of the invention, it is to be understood that this invention may be embodied as more fully described in the claims, or as otherwise known by those skilled in the art (including any and all equivalents), without departing from such principles.

What is claimed is:

1. In a circular floating hull formed from a plurality of sections attached together end-to-end, one section of the hull comprising:

a. a flat circular plate having a central circular cutout;

b. a plurality of curved stiffeners attached to said flat circular plate;

c. a plurality of radial girders attached to said flat circular plate and said curved stiffeners;

d. an inner shell with one end attached to the central circular cutout in said flat circular plate;

e. a plurality of rings that extend around the outer circumference of said inner shell and are spaced longitudinally along the length of said inner shell;

f. an outer shell with one end attached to the outer circumference of said flat circular plate;

g. a plurality of longitudinal stiffeners attached to the inner circumference of said outer shell that stop short of said flat circular plate so as not to penetrate said flat circular plate nor be structurally continuous across said flat circular plate;

h. a plurality of lateral supports attached to the ends of said longitudinal stiffeners, said lateral supports configured to act in tension in either axial direction;

i. a plurality of rings that extend around the inner circumference of said outer shell and are spaced longitudinally along the length of said outer shell; and j. a plurality of lateral supports attached to the rings on said outer shell and arranged to act in tension in either axial direction.

2. The circular floating hull of claim 1, wherein said curved stiffeners are formed from angle iron or bulb tees.

3. The circular floating hull of claim 1, wherein said curved stiffeners are arranged in concentric circles.

4. The circular floating hull of claim 1, wherein said lateral supports attached to said longitudinal stiffeners extend transverse to said longitudinal stiffeners.

5. The circular floating hull of claim 1, wherein said lateral supports attached to the rings on the outer shell are also attached at each end of the hull section.

6. In a circular floating hull formed from a plurality of sections attached together end-to-end, one section of the hull comprising;

a. a flat circular plate having a central circular cutout;

b. a plurality of curved stiffeners attached to said flat circular plate, said curved stiffeners being formed from angle iron or bulb tees and arranged in concentric circles;

c. a plurality of radial girders attached to said flat circular plate and said curved stiffeners;

d. an inner shell with one end attached to the central circular cutout in said flat circular plate;

e. a plurality of rings that extend around the outer circumference of said inner shell and are spaced longitudinally along the length of said inner shell;

f. an outer shell with one end attached to the outer circumference of said flat circular plate;

g. a plurality of longitudinal stiffeners attached to the inner circumference of said outer shell that stop short of said flat circular plate so as not to penetrate said flat circular plate nor be structurally continuous across said flat circular plate;

h. a plurality of lateral supports attached to the ends of said longitudinal stiffeners, said lateral supports arranged to act in tension in either axial direction;

i. a plurality of rings that extend around the inner circumference of said outer shell and are spaced longitudinally along the length of said outer shell; and j. a plurality of lateral supports attached to said rings on said outer shell and arranged to act in tension in either axial direction.

7. The circular floating hull of claim 6, wherein said lateral supports attached to said longitudinal stiffeners extend transverse to said longitudinal stiffeners.

8. The circular floating hull of claim 6, wherein said lateral supports attached to said rings on said outer shell are also attached at each end of the hull section.

9. In a circular floating hull formed from a plurality of sections attached together end-to-end, one section of the hull comprising;

a. a flat circular plate having a central circular cutout;

b. a plurality of curved stiffeners attached to said flat circular plate, said curved stiffeners being formed from angle iron or bulb tees and arranged in concentric circles;

c. a plurality of radial girders attached to said flat circular plate and said curved stiffeners;

d. an inner shell with one end attached to the central circular cutout in said flat circular plate;

e. a plurality of rings that extend around the outer circumference of said inner shell and are spaced longitudinally along the length of said inner shell;

f. an outer shell with one end attached to the outer circumference of said flat circular plate;

g. a plurality of longitudinal stiffeners attached to the inner circumference of said outer shell that stop short of said flat circular plate so as not to penetrate said flat circular plate nor be structurally continuous across said flat circular plate;

h. a plurality of lateral supports attached to the ends of said longitudinal stiffeners, said lateral supports arranged to act in tension in either axial direction;

i. a plurality of rings that extend around the inner circumference of said outer shell and are spaced longitudinally along the length of said outer shell; and j. a plurality of lateral supports attached to said rings on said outer shell and at each end of the hull section and arranged to act in tension in either axial direction.

10. In a circular floating hull formed from a plurality of sections attached together end-to-end, a method for assembling the sections, comprising the steps:

a. positioning a flat circular plate having a central circular cutout in a horizontal position;

b. attaching a plurality of curved stiffeners to the flat circular plate;

c. attaching a plurality of radial girders to the circular flat plate and curved stiffeners;

d. forming a plurality of curved metal sections, each of said curved metal sections having a plurality of rings that extend radially outward;

e. attaching the curved metal sections to the circular cutout in the flat circular plate to form a circular inner shell;

f. attaching a plurality of longitudinal stiffeners to a flat metal plate sized to form part of an outer shell section that stop short of said flat circular plate so as not to penetrate said flat circular plate nor be structurally continuous across said flat circular plate;

g. curving the outer shell section perpendicular to the longitudinal stiffeners and attaching curved ring sections to the outer shell section and the longitudinal stiffeners;

h. attaching a plurality of lateral supports transverse to the rings such that the lateral supports are spaced to correspond to the location of certain longitudinal girders and arranged to act in tension in either axial direction; and i. attaching the formed outer shell sections to the outer circumference of the circular flat plate to form an outer shell.

11. The assembly method of claim 10, further comprising attaching a plurality of lateral supports to the longitudinal stiffeners on the outer shell that are arranged to act in tension in either axial direction.

* * * * *